US010006256B2

(12) United States Patent
Streater, Jr. et al.

(10) Patent No.: US 10,006,256 B2
(45) Date of Patent: Jun. 26, 2018

(54) SAFETY JOINT DESIGNED WITH ANTI-LOCK PRESSURE COMPENSATION SEAL

(71) Applicant: National Oilwell Varco, L.P., Houston, TX (US)

(72) Inventors: James R. Streater, Jr., Humble, TX (US); Daniel Hernandez, Jr., Spring, TX (US); Josefat Rodriguez-Estrada, Jr., Katy, TX (US); Francisco Tejada, Jr., Katy, TX (US)

(73) Assignee: National Oilwell Varco, LLP, Houston, TX (US)

( * ) Notice: Subject to any disclaimer, the term of this patent is extended or adjusted under 35 U.S.C. 154(b) by 356 days.

(21) Appl. No.: 14/946,123

(22) Filed: Nov. 19, 2015

(65) Prior Publication Data

US 2016/0145949 A1 May 26, 2016

Related U.S. Application Data

(60) Provisional application No. 62/082,542, filed on Nov. 20, 2014.

(51) Int. Cl.
*E21B 17/06* (2006.01)

(52) U.S. Cl.
CPC ..... *E21B 17/06* (2013.01)

(58) Field of Classification Search
CPC ..... E21B 17/06; E21B 17/042; E21B 17/07
See application file for complete search history.

(56) References Cited

U.S. PATENT DOCUMENTS

| | | | | |
|---|---|---|---|---|
| 2,204,586 A | | 6/1940 | Grau | |
| 2,836,435 A | * | 5/1958 | Briley | E21B 17/06 285/36 |
| 3,204,992 A | | 9/1965 | Walker | |
| 3,479,059 A | * | 11/1969 | Taylor | F16L 15/003 285/256 |
| 3,895,829 A | | 7/1975 | Manson, Jr. | |
| 4,050,721 A | * | 9/1977 | Streit | F16L 21/025 285/231 |
| 4,434,863 A | * | 3/1984 | Garrett | E21B 4/003 175/297 |

(Continued)

FOREIGN PATENT DOCUMENTS

| | | |
|---|---|---|
| CN | 202360041 U | 8/2012 |
| GB | 849283 A | 9/1960 |

(Continued)

*Primary Examiner* — Daniel P Stephenson
(74) *Attorney, Agent, or Firm* — Jonathan M. Pierce; Porter Hedges LLP

(57) ABSTRACT

Provided is a safety joint with a moveable seal designed to prevent hydrostatic locking. The safety joint is primarily made up assembling a pin end having a first seal, a threaded connection, and a second, moveable seal to a box end. The moveable seal is disposed in a recess formed in the pin end and includes an O-ring and a spring. When the safety joint is assembled downhole, a volume of fluid may become trapped between the first seal and the second seal. The trapped fluid in turn pushes the O-ring towards the spring, thereby limiting pressure build-up by substantially maintaining the volume trapped between the first and second seals.

16 Claims, 4 Drawing Sheets

(56) References Cited

U.S. PATENT DOCUMENTS

| | | | | |
|---|---|---|---|---|
| 4,648,627 | A * | 3/1987 | Reimert | E21B 17/04 285/24 |
| 4,893,844 | A * | 1/1990 | Chelette | E21B 17/042 285/113 |
| 5,476,148 | A * | 12/1995 | LaBonte | E21B 17/07 175/27 |
| 6,279,962 | B1 | 8/2001 | McGarian et al. | |
| 6,305,723 | B1 * | 10/2001 | Schutz | E21B 17/042 285/333 |
| 7,607,333 | B2 * | 10/2009 | Sivley, IV | F16L 15/004 72/367.1 |
| 7,836,958 | B2 | 11/2010 | Gazewood | |
| 8,561,692 | B1 | 10/2013 | Schultz et al. | |
| 8,608,209 | B1 | 12/2013 | Schultz et al. | |
| 2004/0090068 | A1 * | 5/2004 | Evans | E21B 17/042 285/382 |
| 2010/0300698 | A1 * | 12/2010 | Bedouet | E21B 17/003 166/355 |
| 2012/0247880 | A1 | 10/2012 | Bradford | |
| 2016/0145949 | A1 * | 5/2016 | Streater, Jr. | E21B 17/06 166/380 |

FOREIGN PATENT DOCUMENTS

| | | |
|---|---|---|
| RU | 2322564 | 4/2006 |
| SU | 732484 | 5/1980 |

* cited by examiner

SAFETY JOINT DESIGNED WITH ANTI-LOCK PRESSURE COMPENSATION SEAL

CROSS-REFERENCE TO RELATED APPLICATIONS

This application claims priority to U.S. Provisional Application Ser. No. 62/082,542 filed on Nov. 20, 2014, and entitled "Safety Joint Designed with Anti-Lock Pressure Compensation Seal". The priority application is incorporated herein by reference.

TECHNICAL FIELD

The disclosure relates, in general, to downhole safety joints for downhole use in a wellbore. In particular, the disclosure relates to a sealing mechanism for downhole safety joints.

BACKGROUND

Safety joints are commonly used with work strings including drilling, fishing, testing, wash-over, tubing or other strings. They allow the disengagement of the lower portion of the work string at a pre-determined location or position. These safety joints are important in situations in which, for example, a work string becomes stuck in a wellbore. Often times, expensive equipment or tools are present at the lower end of the work string, the retrieval of which is necessary. Safety joints are, therefore, placed below expensive equipment on the work string to ensure that equipment is retrieved once the safety joint is disconnected. Safety joints are designed to break out at a lower torque magnitude than all the connections in the work string so that if the work string gets stuck, there is a known location and a known torque magnitude for disengagement.

Typical safety joints are tubular in shape and made up of two parts, an upper member, or pin, and a lower member, or box, that are connected by known means, such as, for example, coarse threads. When the safety joint is assembled, right hand torque or rotation causes the pin to axially move into the box. When a work string becomes stuck in a wellbore, left hand torque is applied to the work string to uncouple the pin from the box allowing the retrieval of the pin and the work string above it. The design of the safety joints allows their reconnection downhole via the application of right hand torque.

To avoid wash-out of the threads and the loss of fluid through the work string, two seals, (for example, O-rings), are usually installed on both sides of the threaded connection. When the safety joint is assembled on the surface, there is no wellbore fluid present and hence no problem during assembly of the safety joint. However, when wellbore fluid is present in the environment of the safety joint, particularly in the box, a volume of fluid gets trapped between the aforementioned two seals. This trapped fluid may pose a problem for reengaging the safety joint downhole. During reengagement, the volume between the two seal may be reduced and the wellbore fluid may be compressed, creating what is referred to as a hydraulic lock. This fluid compression, or hydraulic lock, results in an internal reaction force that reduces the tightening of the connection as torque is applied to the safety joint. This reduction of the tightening could cause an operator to assume that the safety joint is safely made up to its required makeup torque, when it is not made up at all. Further, the break out torque required to disengage the connection may be reduced as well, and consequently the safety joint may accidentally disconnect.

Currently, a number of options exist that aim to solve the problem of hydraulic lock between the two seals. For example, one or both of the seals could be removed to prevent trapping and compressing wellbore fluids altogether when reengaging the safety joint. However, this approach has drawbacks. Removing both seals means that there is no way of preventing washout of the threads if there is pressurized wellbore fluid circulating in the work string. Removing just one of the seals would not result in washout, but the life of the threads would be reduced due to corrosion pitting by the wellbore fluid.

There is a need, therefore, for a safety joint designed in a manner that ensures its safe and proper reengagement in downhole environment.

SUMMARY

In one or more aspects, a downhole safety joint for use in a wellbore comprises a tubular pin end. The tubular end includes a first portion having a first outer diameter, a second portion having a second outer diameter that is smaller than the first diameter, and an external thread formed between the first and second portions. The downhole safety joint further comprises a tubular box end including an internal thread configured to engage the external thread of the tubular pin end, a first seal located adjacent the first portion; and a second seal located adjacent the second portion. The second seal is a moveable seal including a spring and a sealing member. The spring may be adjacent to the sealing member. The sealing member may comprise an extrusion ring and an O-ring. The downhole safety joint may further comprise a snap-ring disposed between the sealing member and the spring. The downhole safety joint may further comprise a recess formed adjacent to the second bearing portion for housing the second seal. The spring may surround the recess. The downhole safety joint may further comprise a helical groove formed in the second bearing portion. The second bearing portion may include a retainer sleeve enclosing the sealing member and the spring. The downhole safety joint may further be configured such that the sealing member moves in a recess formed on the tubular pin end and compresses the spring to maintain a constant volume between the first seal and the second seal when the safety joint is assembled.

In one or more aspects, a method of assembling a safety joint involves providing a tubular pin end including a first portion having a first outer diameter, a second portion having a second outer diameter that is smaller than the first diameter, and an external thread formed between the first and second portions. The method further involves providing a tubular box end including an internal thread configured to engage the external thread of the tubular end pin. The method further involves providing a first seal located adjacent the first portion. The method further involves providing a second seal located adjacent the second portion, wherein the second seal is a moveable seal including a spring and a sealing member. The method further involves assembling the first seal, the second seal on to the tubular pin end, and coupling the tubular pin end and the tubular box end by torquing the tubular pin end into the tubular box end. The method may further involve moving the sealing member in a recess formed on the tubular pin end while compressing the spring. The method may further involve compressing the spring to maintain a constant volume between the first seal and the second seal when the safety joint is assembled.

In one or more aspects, a downhole safety joint for use in a wellbore comprises a tubular pin end including an threaded portion, a first seal disposed on a first side of the threaded, and a second seal disposed on a second side of the threaded portion opposite to the first side, wherein the second seal is a moveable seal including a spring and a sealing member. The downhole safety joint further comprises a tubular box end configured to engage the threaded portion of the tubular pin end. The downhole safety joint may further comprise a recess formed adjacent to the second bearing portion for housing the second seal. The spring may surround the recess. The downhole safety joint may further comprise a helical groove formed in the second bearing portion. The second bearing portion may include a retainer sleeve enclosing the sealing member and the spring. The spring may be adjacent to the sealing member. The sealing member may comprise an extrusion ring and an O-ring. The downhole safety joint may further comprise a snap-ring disposed between the sealing member and the spring.

BRIEF DESCRIPTION OF THE DRAWINGS

It being understood that the figures presented herein should not be deemed to limit or define the subject matter claimed herein, the applicants' invention may be understood by reference to the following description taken in conjunction with the accompanying drawings, in which:

It is noted, however, that the figures are not necessarily drawn to scale.

DESCRIPTION OF ILLUSTRATIVE EMBODIMENTS

Illustrative embodiments of the invention are described below. In the interest of clarity, not all features of an actual implementation are described in this specification. The following detailed description of exemplary embodiments, read in conjunction with the accompanying drawings, is merely illustrative and is not to be taken as limiting the scope of the invention. Rather, the scope of the invention is defined by the appended claims and equivalents thereof. It will of course be appreciated that in the development of an actual embodiment, numerous implementation-specific decisions must be made to achieve design-specific goals, which will vary from one implementation to another. Moreover, it will be appreciated that such a development effort, while possibly complex and time-consuming, would nevertheless be a routine undertaking for persons of ordinary skill in the art having the benefit of this disclosure. Further aspects and advantages of the various embodiments of the invention will become apparent from consideration of the following description and drawings.

A safety joints according to the present disclosure may solve the aforementioned hydraulic lock problem. The safety joints may be designed such that the reduction of volume trapped between two seals is minimized by providing a moveable seal.

Figures 1, 1A:
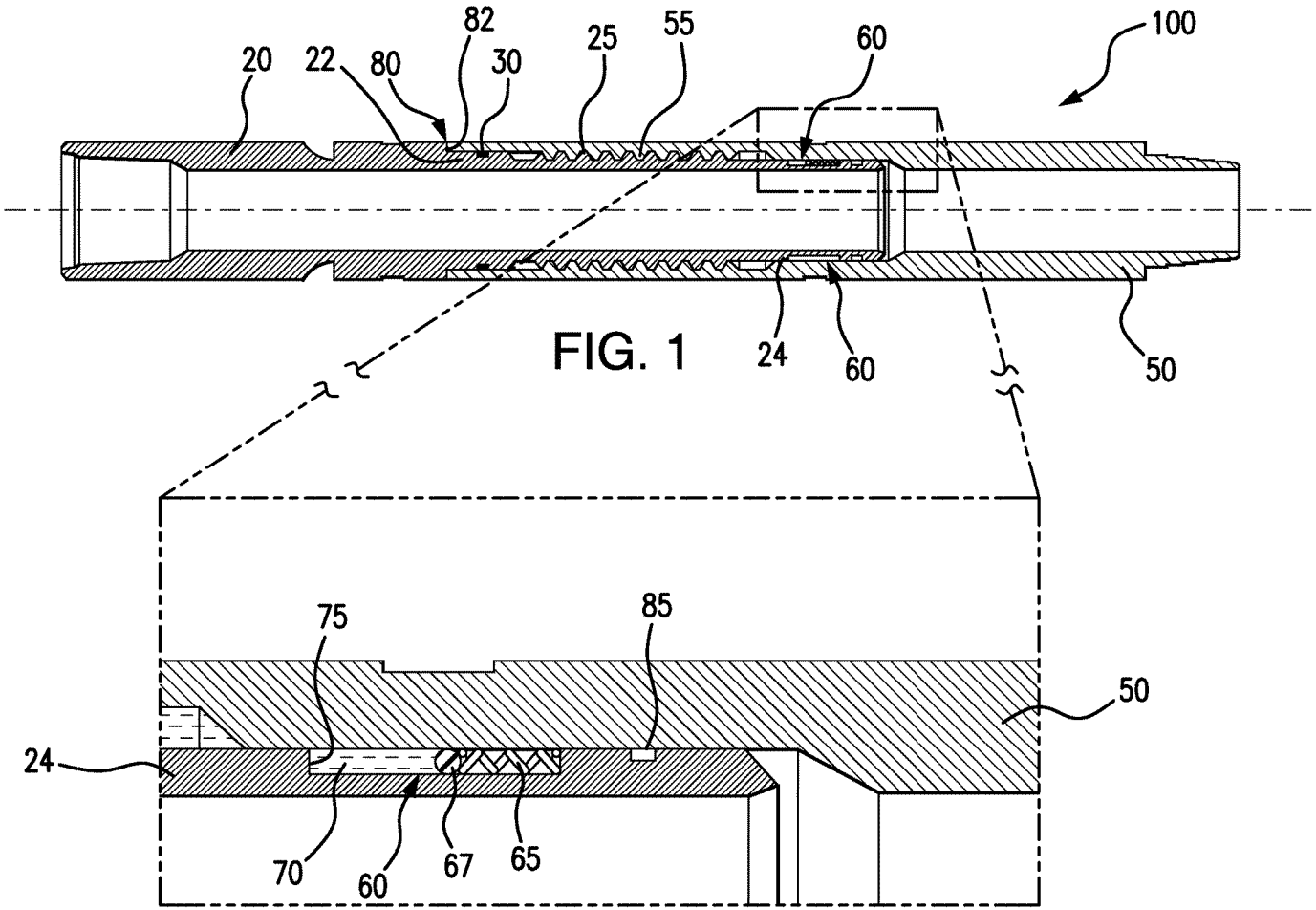
FIG. 1 is a sectional view of a safety joint representative according to one embodiment.
FIG. 1A is a sectional view of a portion of the safety joint shown in FIG. 1.

Referring to FIG. 1, a safety joint 100 comprises a first tubular sub having a pin end 20 and second tubular sub having a box end 50 that are coupled to each other using threads, such as coarse Acme threads, or modified Acme threads. As such, the pin end 20 comprises a threaded portion 25 configured to engage a corresponding threaded portion 55 in the box end 50. The first tubular sub and second tubular sub comprises threaded connectors 21 and 51, respectively, for coupling the safety joint to a work string (not shown). When assembled as shown in FIG. 1, the pin end 20 extends into the box end 50. A shoulder 82 of the box end 50 abuts a shoulder 80 of the pin end 20.

The pin end 20 has a first portion 22 having a first diameter, and a second portion 24 having a second diameter. The first diameter may be greater than the second diameter. The second portion 24 is axially offset from the first portion 22 so that the threaded portion 25 is located axially between the first and second portions. The first and second portions are configured to engage the inner diameter of the box end 50 and transmit bending loads between the pin end 20 and the box end 50.

To avoid wash-out of the threads and the loss of fluid through the safety joint 100, two seals, first seal 30 and second seal 60, are installed on both sides of the threaded portion 25. As the pin end 20 is made up onto the box end 50, an axial relative movement therebetween causes engagement the first seal 30 with an inner surface of the box end 50, followed by engagement of the second seal 60, before the threaded connection is fully made up and the shoulder 80 on pin end 20 mates with the shoulder 82 on box end 50. The first seal 30 may be located in or adjacent the first portion 22, and the second seal 60 may be located in or adjacent the second portion 24. Thus, the sealing diameter of the first seal 30 may be larger than the sealing diameter of the second seal 60.

Figure 2:
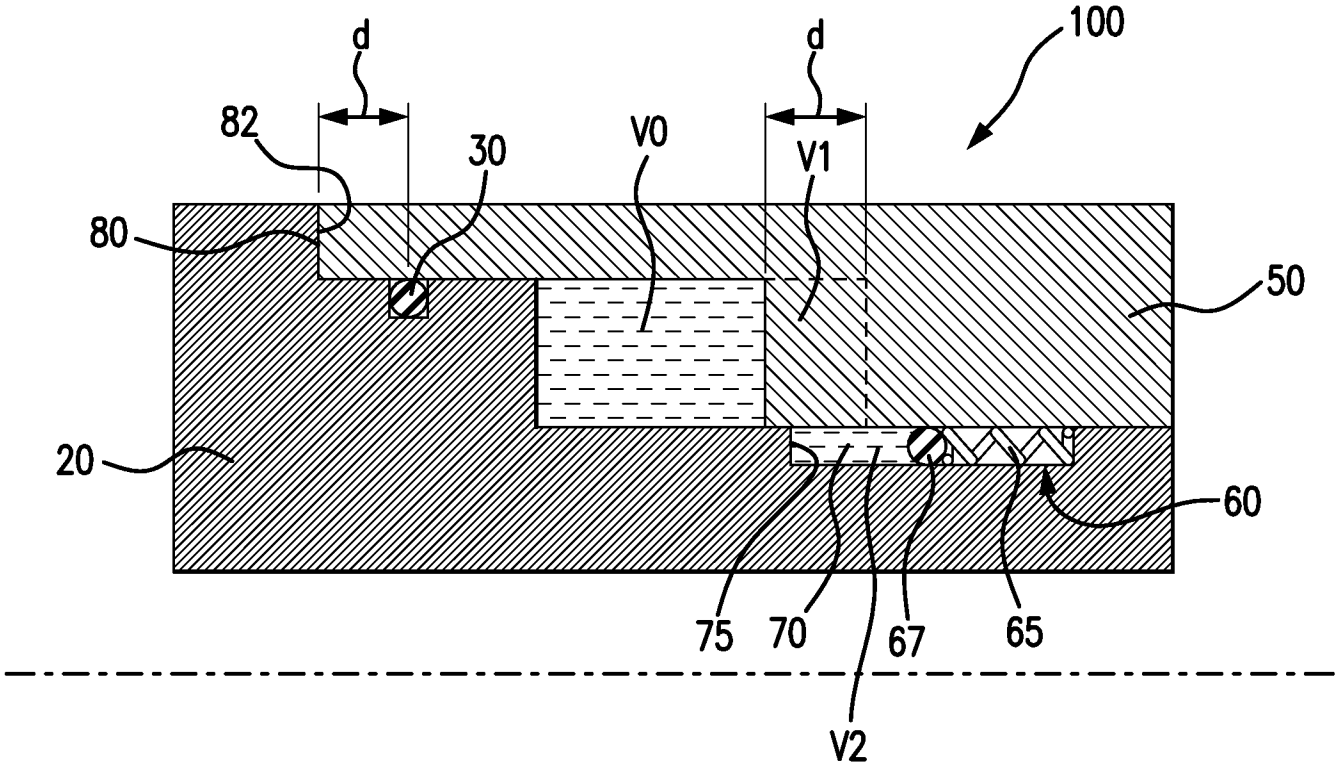
FIG. 2 is a schematic illustrating a moveable seal that can compensate for volume reduction by allowing the seal to travel in a groove.

When the safety joint 100 is assembled on the surface, there is usually no wellbore fluid in the safety joint. As a result, there is usually no issue assembling the safety joint 100 since there is no fluid trapped between the first seal 30 and the second seal 60. However, when wellbore fluid is present, such as when the safety joint 100 is reconnected downhole, there is a volume of fluid that is effectively trapped between the two seals as shown in FIG. 2. In the safety joint 100, the second seal 60 is a moveable seal that allows the volume of trapped wellbore fluid to remain constant (i.e. preventing a large increase in the pressure of wellbore fluid being trapped between the seals) as the safety joint 100 is connected. This moveable seal may allow the safety joint 100 to reliably reconnect downhole. It should be noted that while the second seal 60 is shown to be the moveable seal in FIG. 1, other embodiments may differ as long as at least one of the first seal 30 and the second seal 60 is a moveable seal.

FIG. 1B shows a portion of the safety joint 100 in more detail. The second seal 60 may comprise a spring 65 and a sealing member 67 disposed in and surrounding a recess 70 located in or adjacent to the second portion 24. The recess 70 is formed sufficiently wide to permit the movement of the sealing member 67. The sealing member 67 may comprise, for example, an O-ring and an anti-extrusion ring. The spring 65 may compress and allow a sealing member 67 to move back and forth in the recess 70. However, a person of skill in the art would recognize that the spring 65 may still perform its intended function if separated from the sealing member 67 but still adjacent to it. The spring 65 may be used maintain a constant or near constant volume of fluid trapped between the first seal 30 and second seal 60. For example as shown in FIG. 1A, wellbore fluid may apply a pressure on the sealing member 67 and push it away from a shoulder 75 of the recess 70. When the pressure in the fluid pressure is released, the spring 65 may push the sealing member 67 back against the shoulder 75. As the safety joint 100 is disassembled, the spring 65 applies a reactionary force on the moveable seal and may push it back to its original location.

As illustrated in FIG. 2, when the safety joint 100 is assembled, right-hand torque or rotation causes the pin end 20 to move axially into the box end 50. As the pin end 20 is inserted into the box end 50, the first seal 30 is engaged. With the continued axial movement, the second seal 60 is also engaged, thereby trapping a volume of compressed fluid or gas inside. As the pin end 20 further moves axially into the box end 50 by a distance d, until engagements of the shoulders 80 and 82, the volume of fluid V0 trapped between the two seal surfaces is displaced. The displaced volume V1 is compensated by a volume V2 added by the movement of the second seal 60, that is, by the compression of the spring 65 and the retraction of the sealing member 67 away from the shoulder 75 of the recess 70. This volume compensation results in minimal pressure increase of the wellbore fluid trapped between the first seal 30 and the second seal 60. Thus hydraulic lock may be prevented. At this final position illustrated in FIG. 2, the sealing member 67 no longer moves and is held in place with a balance of the spring force and the internal pressure. Conversely, as the safety joint 100 is disassembled, the spring 65 force applied to the sealing member 67 may extend the sealing member back to its original location against the shoulder 75 in the recess 70.

Figure 3:
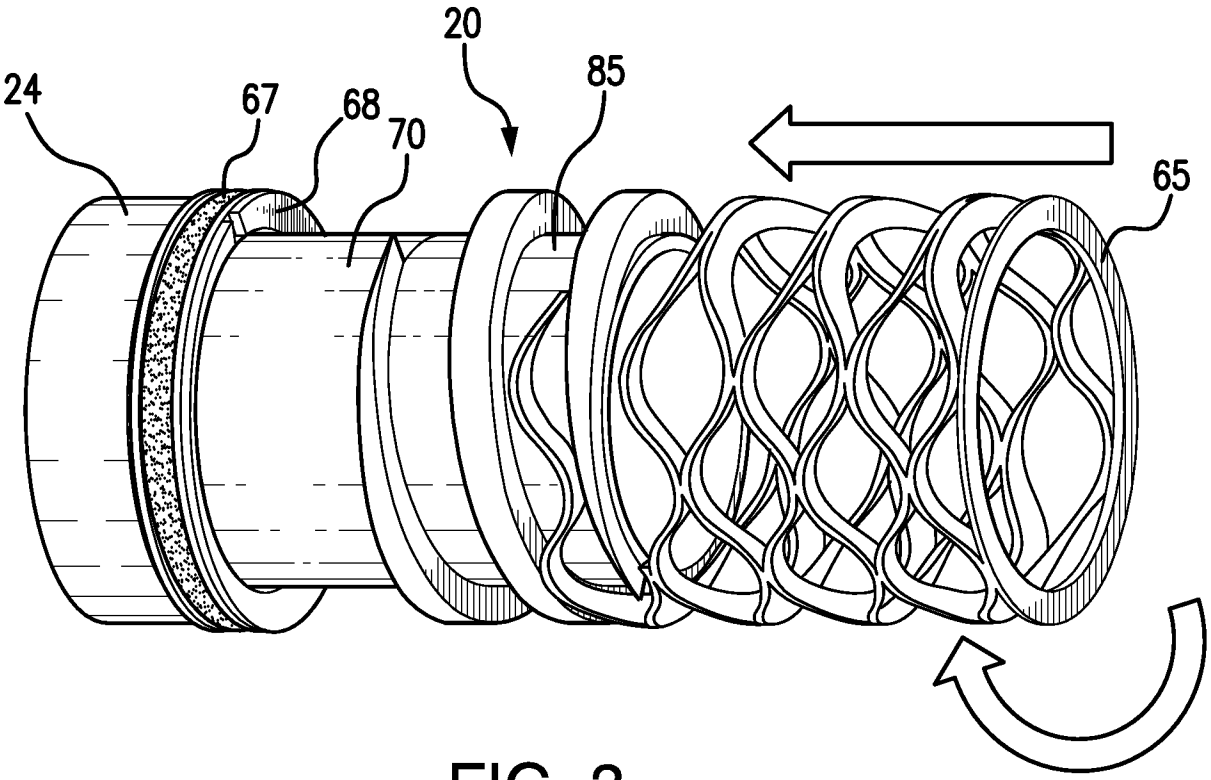
FIG. 3 is a perspective view of a portion of a safety joint illustrating assembly of a moveable seal.

An embodiment of the safety joint 100, and in particular of the second portion 24 and the second seal 60 is illustrated in FIG. 3. In the embodiment of FIG. 3, the second seal 60 includes an optional snap ring 68 to distribute the load of the spring uniformly on the sealing member 67. The spring 65 is installed onto the recess 70, through a helical groove 85 formed in the second portion 24. The helical groove 85 serves as a pathway allowing the installation of the spring 65 into the recess 70. Such a design, i.e., the helical groove 85 formed in the second portion 24 of the safety joint 100, may permit to make the pin end 20 as a unitary body, while preserving some bending support between the pin end 20 and box end 50 with two portions.

The helical groove 85 may be specifically sized to allow the spring 65 to pass through at least a portion of the second portion 24 without having to excessively enlarge the spring 65. Thus, the helical groove 85 may help minimizing the risk of damaging the spring 65 during the installation.

Figure 4A:
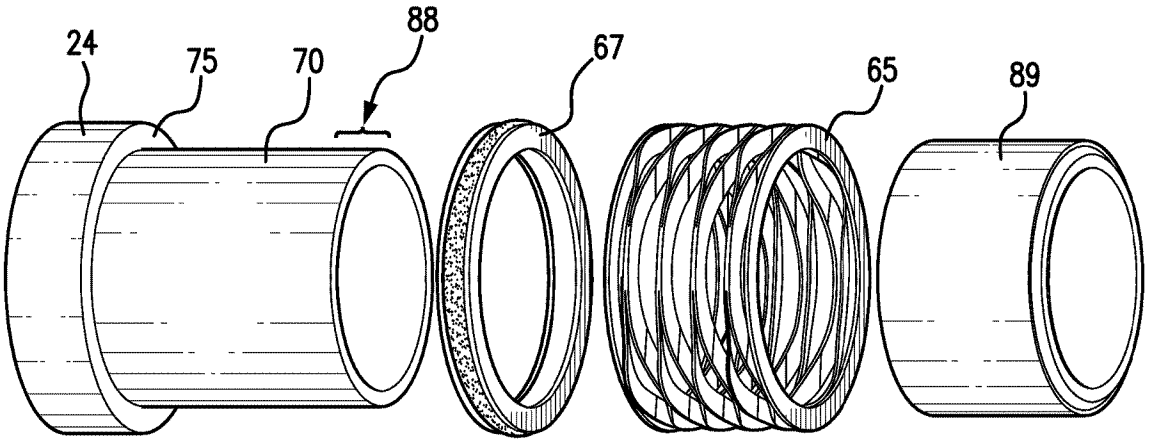
FIG. 4A is an exploded view of a portion of a safety joint having a moveable seal according to one embodiment.
Figure 4B:
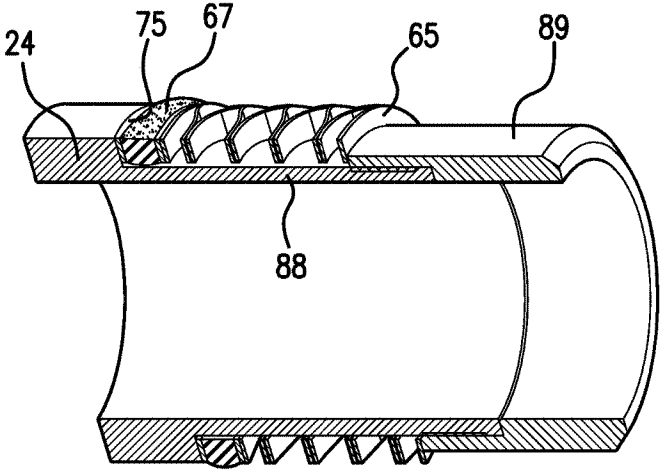
FIG. 4B is a perspective, partially sectional view of the portion of the safety joint shown in FIG. 4A illustrating the moveable seal after assembly.

As shown in FIGS. 4A-4B, an alternate embodiment of the safety joint 100 includes a second portion 24 made of a two pieces that allow the sealing member 67 and the spring 65 of the second seal 60 to be disposed in and surround the recess 70. A retainer sleeve 89 then encloses the second seal 60 in the recess 70. As shown in FIGS. 4A and 4B, a distal end of the pin end 20 is provided with a receiving portion 88 onto which the retainer sleeve 89 may be press fitted, threaded, welded or otherwise coupled to the pin end 20. Radial support between the pin end 20 and the box end 50 is provided through the retainer sleeve 89 which forms part of the second portion 24.

In view of the foregoing and the appended Figures, those skilled in the art will recognize that some aspects of the present disclosure pertain to a safety joint that may be disconnected and properly reconnected under downhole environment without the formation of a hydraulic lock. Some aspects of the present disclosure pertain to the inclusion of a moveable seal in the safety joint that ensures its disconnection and correct reengagement in downhole environment by allowing the volume trapped between two seals to be maintained rather than reduced as prior designs do, thereby preventing the formation of a hydraulic lock. The safety joint, in accordance with the present disclosure, has a moveable seal comprising a sealing member and a spring. In an embodiment, the sealing member includes an O-ring seal.

Some aspects of the present disclosure further pertains to a downhole safety joint for use in a wellbore comprising a tubular pin end including a first portion having a first outer diameter and a second portion having a second outer diameter. The second diameter may be smaller than the first diameter. An external thread may be located between the first and second portions. The downhole safety joint may further comprise a tubular box end having an internal thread configured to engage the external thread of the tubular pin end. The downhole safety joint may further comprise a first seal and a second seal located on each side of the external thread. At least one of the first and second seal is a moveable seal having a spring adjacent to a sealing member. In an embodiment, the spring is adjacent to the sealing member. In alternate embodiments a snap ring may be added between the spring and the sealing member to help distributing the load on the sealing member. The downhole safety joint is further configured such that the spring compresses to maintain a constant volume between the first seal and the second seal when the tubular pin end and tubular box end are assembled downhole, or in presence of wellbore fluid. The downhole safety joint may avoid hydraulic lock during connection.

In an embodiment of the present disclosure, the safety joint is configured such that when the tubular pin end and the tubular box end are engaged, the moveable seal is displaced and held in place by the spring. In a further embodiment, the tubular pin end includes a recess that houses the second seal. The spring may surround at least part of the recess. In a further embodiment, the movable seal may comprise an extrusion ring or a snap-ring.

Some aspects of the present disclosure also pertains to a method for assembling a safety joint involving providing a tubular pin end including a first portion having a first diameter and a second portion having a second diameter such that the second diameter is smaller than the first diameter, and wherein the second bearing portion comprises an external thread. The method further involves providing a tubular box end comprising an internal thread configured to engage the external thread of the tubular pin end. The method further involves providing a first seal located on a first side of the external thread, providing a second seal located on a second, opposite to the fist, side of the external thread, and providing a spring adjacent the second seal. The method further involves assembling the first seal, the second seal and the spring to the tubular pin end and engaging the tubular pin end and the tubular box end by threading.

In an embodiment, the tubular pin end is formed as a unitary body and the installation of the spring of the moveable seal is performed by rotating the spring in a helical groove such that the spring passed into the groove into its final placement location. In another embodiment, the tubular pin end is formed as a two piece system that allows the spring and the sealing member of the moveable seal to be inserted first into a recess followed by the mating of a retainer sleeve to enclose the moveable seal. In an embodiment of the method for assembling the safety joint, the pin and the box ends are configured such that when the pin and the box ends are engaged, the moveable seal is displaced against the spring.

Some aspects of the present disclosure also pertain to a moveable seal for use in safety joint wherein the moveable seal comprises an O-ring seal and a spring. The moveable seal moves in a groove in said safety joint so as to maintain a volume trapped by the moveable seal constant when the safety joint is assembled in an environment where wellbore fluid or other fluid is present.

It will be understood by one of ordinary skill in the art that in general any subset or all of the various embodiments and inventive features described herein may be combined, notwithstanding the fact that the claims set forth only a limited number of such combinations. For example, while embodiments of a moveable seal implemented on a pin end have been described, the moveable seal may be implemented on a box end instead.

What is claimed is:

1. A downhole safety joint for use in a wellbore, comprising:

a tubular pin end including a first portion having a first outer diameter, a second portion having a second outer diameter that is smaller than the first outer diameter, and an external thread formed between the first and second portions;

a tubular box end including an internal thread configured to engage the external thread of the tubular pin end;

a first seal located adjacent the first portion;

a second seal located adjacent the second portion, wherein the second seal is a moveable seal including a spring and a sealing member, wherein the spring is compressed in response to the sealing member moving away from the first seal; and a recess formed on the tubular pin end and adjacent to the second portion for housing the second seal.

2. The downhole safety joint of claim 1, wherein the spring is adjacent to the sealing member.

3. The downhole safety joint of claim 1, wherein the sealing member comprises an extrusion ring and an O-ring.

4. The downhole safety joint of claim 1, further comprising a snap-ring disposed between the sealing member and the spring.

5. The downhole safety joint of claim 1, wherein the spring surrounds the recess.

6. The downhole safety joint of claim 1, further comprising a helical groove formed in the second portion.

7. The downhole safety joint of claim 1, wherein the second portion includes a retainer sleeve enclosing the sealing member and the spring.

8. A method of assembling a safety joint comprising:

providing a tubular pin end including a first portion having a first outer diameter, a second portion having a second outer diameter that is smaller than the first diameter, and an external thread formed between the first and second portions;

providing a tubular box end including an internal thread configured to engage the external thread of the tubular end pin;

providing a first seal located adjacent the first portion;

providing a second seal located adjacent the second portion, wherein the second seal is a moveable seal including a spring and a sealing member;

assembling the first seal, the second seal on to the tubular pin end;

coupling the tubular pin end and the tubular box end by torquing the tubular pin end into the tubular box end; and moving the sealing member in a recess formed on the tubular pin end away from the first seal while compressing the spring.

9. The method of claim 8, further comprising compressing the spring to maintain a constant volume between the first seal and the second seal when the safety joint is assembled.

10. A downhole safety joint for use in a wellbore, comprising:

a tubular pin end including a threaded portion, a first seal disposed on a first side of the threaded portion, and a second seal disposed on a second side of the threaded portion opposite to the first side, wherein the second seal is a moveable seal including a spring and a sealing member, wherein the spring is compressed in response to the sealing member moving away from the first seal;

a tubular box end configured to engage the threaded portion of the tubular pin end; and a recess formed on the tubular pin end on the second side of the threaded portion for housing the second seal.

11. The downhole safety joint of claim 10, wherein the spring surrounds the recess.

12. The downhole safety joint of claim 10, further comprising a helical groove formed on the second side of the threaded portion.

13. The downhole safety joint of claim 10, wherein the second side of the threaded portion includes a retainer sleeve enclosing the sealing member and the spring.

14. The downhole safety joint of claim 10, wherein the spring is adjacent to the sealing member.

15. The downhole safety joint of claim 10, wherein the sealing member comprises an extrusion ring and an O-ring.

16. The downhole safety joint of claim 10, further comprising a snap-ring disposed between the sealing member and the spring.

* * * * *